US006349777B1

(12) United States Patent
Burenga et al.

(10) Patent No.: US 6,349,777 B1
(45) Date of Patent: Feb. 26, 2002

(54) POST DRIVER HAVING ADJUSTABLE LEGS

(75) Inventors: Thomas I. Burenga, County of Montgomery; Ross D. Koberlein, County of Fayette, both of IL (US)

(73) Assignee: Worksaver, Inc., Litchfield, IL (US)

( * ) Notice: Subject to any disclaimer, the term of this patent is extended or adjusted under 35 U.S.C. 154(b) by 356 days.

(21) Appl. No.: 08/888,663

(22) Filed: Jul. 7, 1997

(51) Int. Cl.[7] ..... E21B 3/04

(52) U.S. Cl. ..... 173/187; 173/28; 173/90; 173/42; 173/191

(58) Field of Search ..... 173/186, 187, 173/188, 189, 46, 28, 184, 42, 26, 190, 191, 90; 175/162

(56) References Cited

U.S. PATENT DOCUMENTS 2,660,403 A * 11/1953 Roland ..... 173/189
2,834,576 A * 5/1958 Ivey ..... 173/187
2,894,723 A * 7/1959 Gustafson ..... 173/187
2,940,267 A * 6/1960 Shaver ..... 173/46
3,026,948 A * 3/1962 Pettee ..... 173/187
3,783,953 A * 1/1974 Kopaska ..... 173/187
4,544,176 A * 10/1985 Helmick ..... 173/42
4,641,715 A * 2/1987 Stinson et al. ..... 173/90
4,915,180 A * 4/1990 Schisler ..... 173/193
5,010,710 A * 4/1991 Gray et al. ..... 173/90
5,090,486 A * 2/1992 Jones ..... 173/28
5,174,386 A * 12/1992 Crover ..... 173/53
5,282,511 A * 2/1994 Burenga et al. ..... 173/184
5,437,341 A * 8/1995 Horn et al. ..... 173/28

* cited by examiner

*Primary Examiner*—Scott A. Smith
(74) *Attorney, Agent, or Firm*—Paul M. Denk

(57) ABSTRACT

A post driver which is mounted to the three-point hitch of a tractor is provided with a support to reduce wobble of the post driver during operation and to facilitate mounting of the post driver to the tractor's three-point hitch. The post driver has a carriage and a ram movable vertically relative to said carriage. The carriage is mounted to a base. The base includes a mount adapted for mounting the post driver to a hitch of a vehicle. A support frame depends from the mount rearwardly of the carriage. The frame has a vertical member and a horizontal member, and generally vertically extending legs at the ends of the horizontal member. The legs are mounted to the horizontal member to be movable vertically relative to the horizontal member. The legs are spaced equidistantly from the carriage of the post driver.

8 Claims, 3 Drawing Sheets

POST DRIVER HAVING ADJUSTABLE LEGS

CROSS-REFERENCE TO RELATED APPLICATIONS

Not Applicable

STATEMENT REGARDING FEDERALLY SPONSORED RESEARCH OR DEVELOPMENT

Not Applicable.

BACKGROUND OF THE INVENTION

This invention relates to post drivers, and in particular, to a post driver having adjustable legs.

Post drivers are used to drive posts for fencing and the like into the ground. Typically, when used with a tractor, the post drivers are mounted to the tractor's three point hitch. When the tractor is operated, i.e., when a post is being driven, the post driver mounted to the hitch will bounce around some due to rear tractor tire bounce and the looseness in the linkage of the three point hitch. It would be desirable to reduce the bouncing around of the post driver.

Further, post drivers are very heavy. If they are stored lying down, the operator will need help in setting it upright and mounting it on the back of the tractor the next time it is to be used. Therefore, the post drive is generally stored hanging above the ground so that the tractor may be driven to position its three-point beneath the mount of the post driver. Typically, post driver are hung on a post, from a tree, or from an overhead barn beam.

BRIEF SUMMARY OF THE INVENTION

One object of the present invention is to provide a support for a post-driver which will reduce some of the bounce.

Another object is to provide such a support which will enable the post driver to be stored in an upright position, such that it may be easily mounted to the three-point hitch of a tractor.

Another object is to provide such a support which is adjustable.

Another object is to provide such a support which is easy to operate.

These and other objects will become apparent to those skilled in the art in light of the following disclosure and accompanying drawings.

Briefly stated, a post driver has a carriage and a ram movable vertically relative to the carriage. The carriage is mounted to a base, and the base includes a mount adapted for mounting the post driver to a hitch of a vehicle, such as the three point hitch of a tractor. A support frame having vertically adjustable legs depends from the mount. The support frame include a vertical member and a horizontal member. The vertical member depends from the mount, and the horizontal member is welded to the bottom of the vertical member, such that the vertical member is generally centered with respect to the horizontal member. The horizontal member has first and second ends which are spaced equidistantly from the carriage of the post driver. Vertically extending legs are mounted to the ends of the horizontal member to be movable vertically relative to said horizontal member.

A tube is mounted to each end of the horizontal member through which the legs are journaled. The tubes have at least one hole extending therethrough, and the legs each have a plurality of vertically spaced apart holes which extend through it. A pin is passed through the holes of the tube and the leg to secure the legs in a desired position relative to the tube.

BRIEF DESCRIPTION OF THE SEVERAL VIEWS OF THE DRAWINGS

Corresponding reference numerals will be used throughout the several figures of the drawings.

DETAILED DESCRIPTION OF THE INVENTION

The following detailed description illustrates the invention by way of example and not by way of limitation. This description will clearly enable one skilled in the art to make and use the invention, and describes several embodiments, adaptations, variations, alternatives and uses of the invention, including what we presently believe is the best mode of carrying out the invention.

A post driver 1 of the present invention includes a carriage 3 and a ram 5 which is movable relative to the carriage 3. The ram 5 and carriage 3 are described in U.S. Pat. No. 5,282,511, which is incorporated herein by reference. Typically, the ram 5 is lifted hydraulically, a post is positioned in the ram, and then the ram is hydraulically operated to drive the post into the ground.

Figure 1:
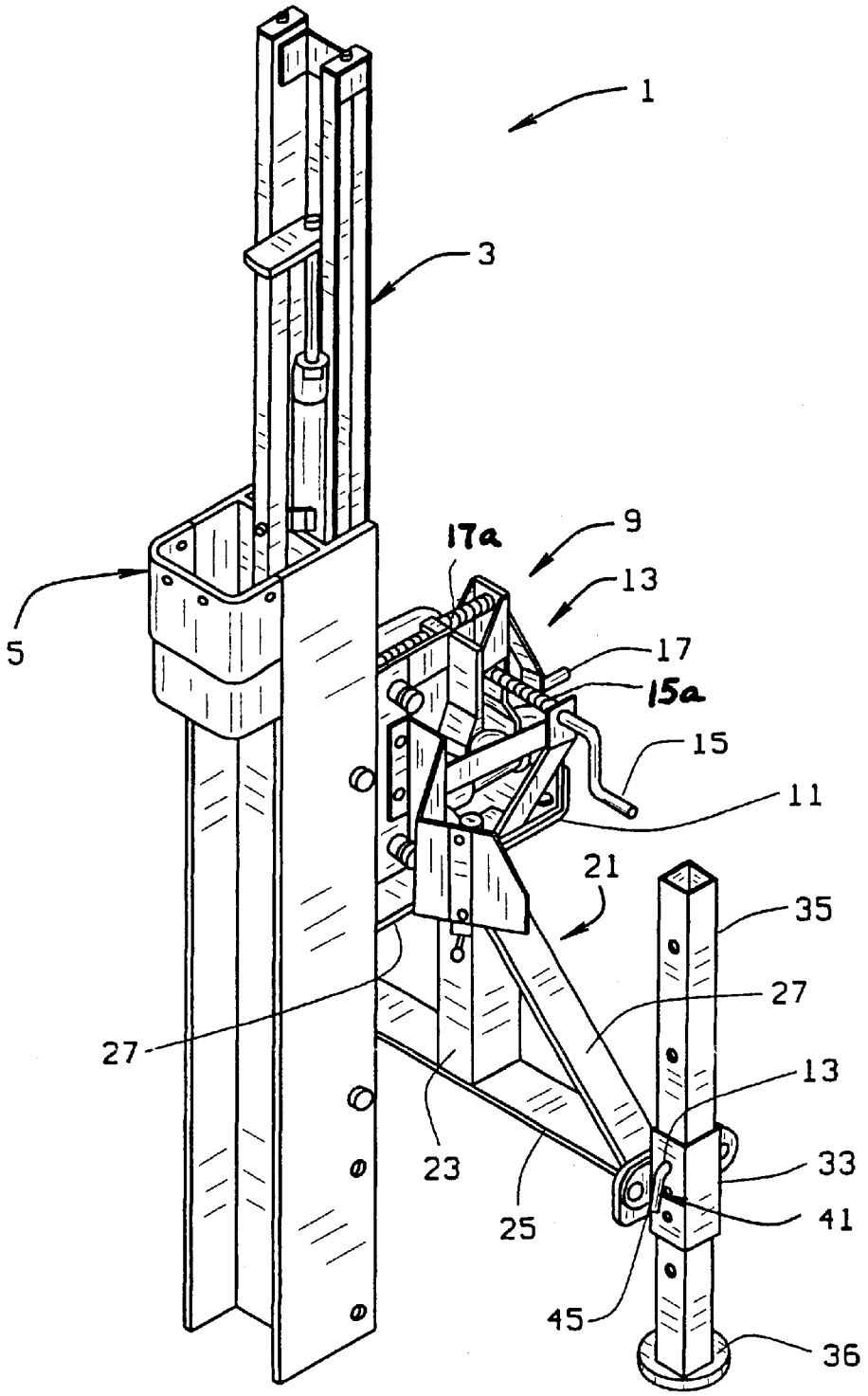
FIG. 1 is a perspective view of a post diver of the present invention.
Figure 2:
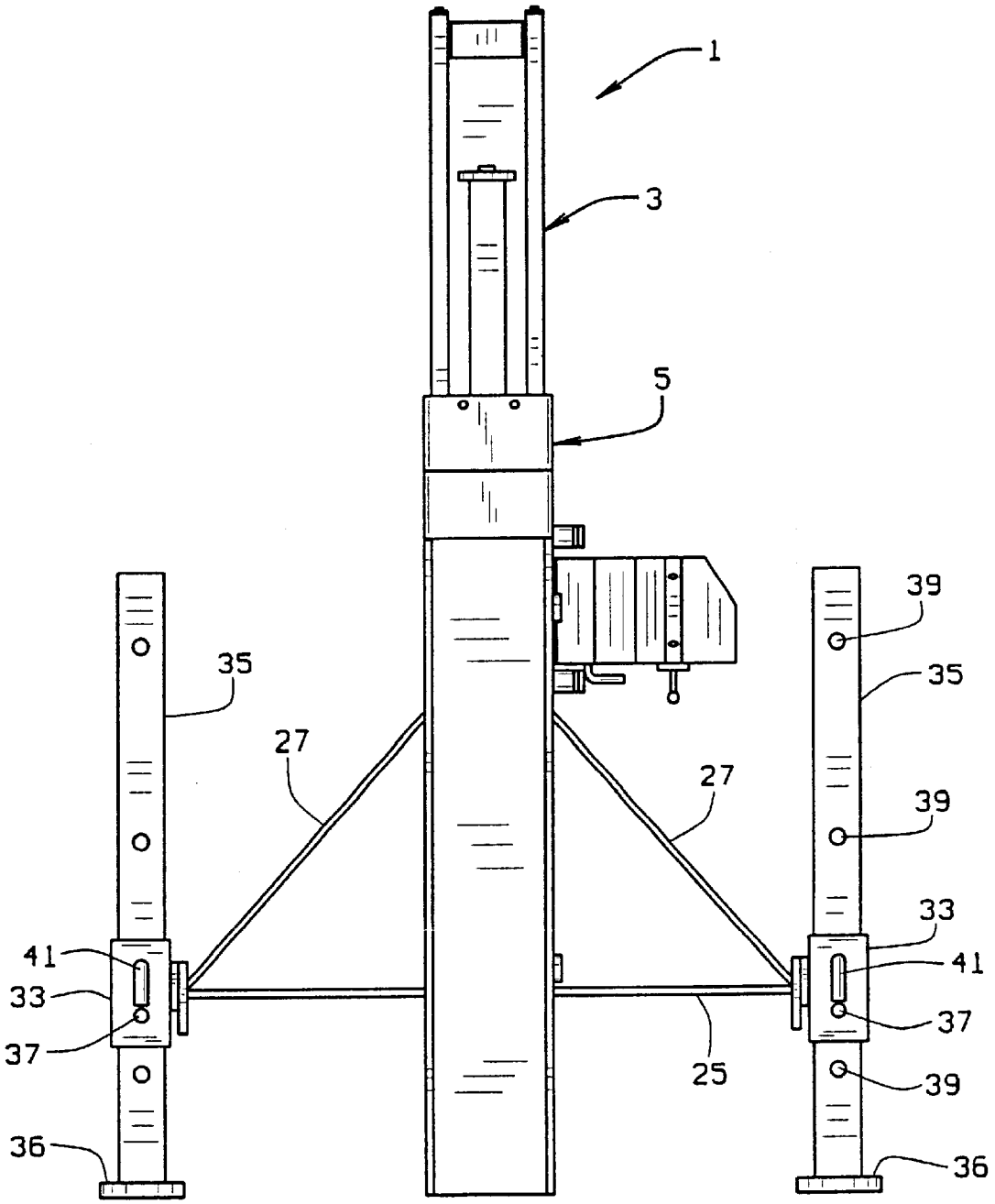
FIG. 2 is a front elevational view of the post driver.
Figure 3:
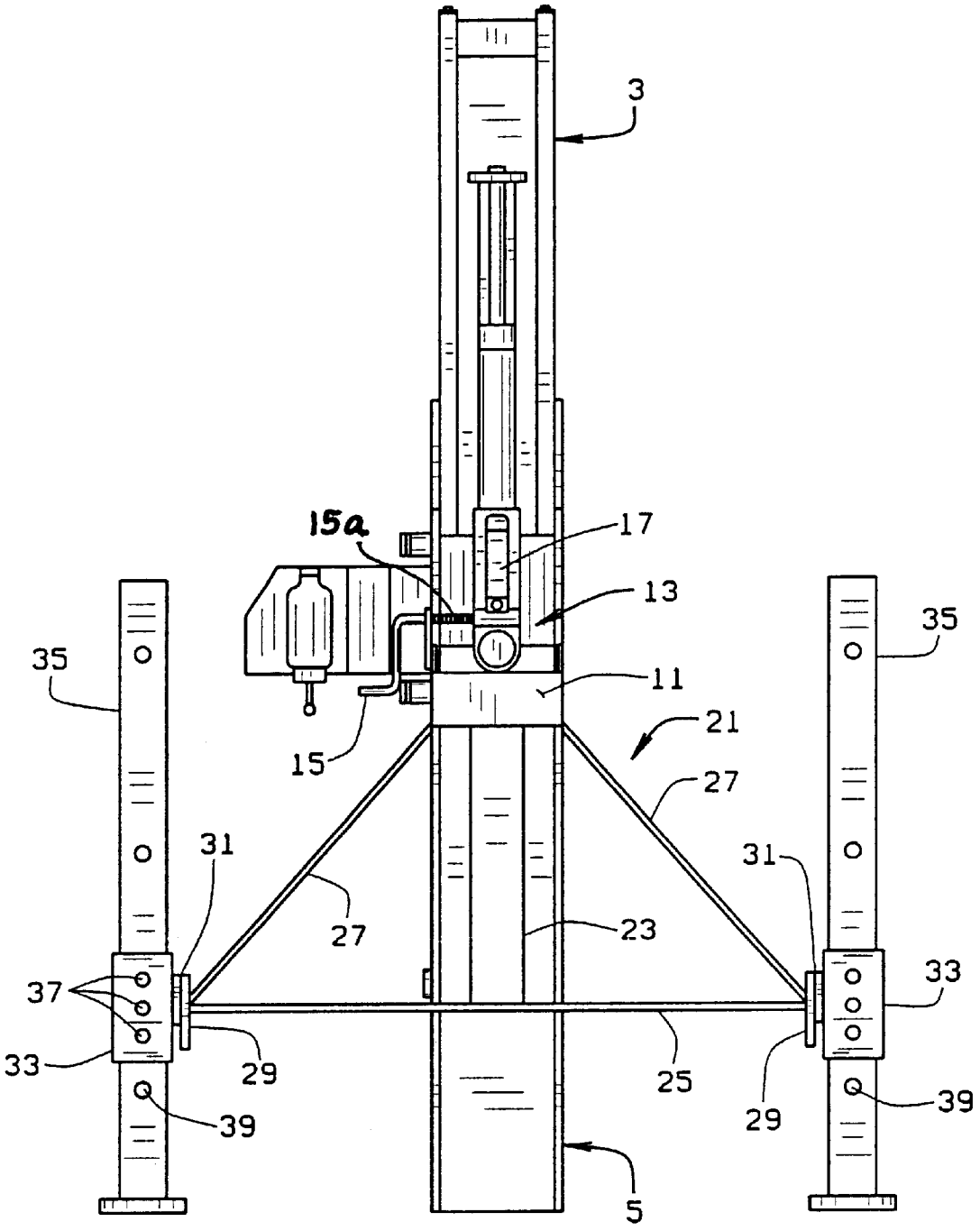
FIG. 3 is a rear elevational view of the post driver.

The carriage 3 is mounted to a base 9. The base 9 includes a mount 11 which is adapted to be mounted to the three point hitch of a tractor, so that the post driver 1 can be mounted to a tractor. An adjusting assembly 13 is mounted to the mount 11. The adjusting assembly is provided with a pair of crank arms 15 and 17, which are provided, similar to what is described in the above-noted patent, to move the carriage 3 and ram 5 in a plane generally parallel to the ground to properly position the post driver. This is achieved by a turning of the crank 15, which in turn turns its integral screw 15*a*, as noted in FIGS. 1 and 3, to provide for lateral adjustment of the adjusting assembly 13. In addition, by turning the crank 17, and its integral screw 17*a*, this provides for forward and apt adjustment to the adjusting assembly, and its mounted carriage 3, as can be noted in FIG. 1. Thus, the post-driver does not have to be fully positioned by movement of the tractor, and fine positioning of the post driver 1 can be accomplished with the cranks 15 and 17, and their integral screws 15*a* and 17*a*, after the tractor has been maneuvered to generally position the post driver over the desired location where the post will be driven into the ground.

A support frame 21 depends from the mount 11. The support frame 21 includes a vertical member 23 which extends downwardly from the bottom of the mount 11. The vertical member is preferably made from square tube stock. A horizontal member 25 extends perpendicularly from the bottom of the vertical member 23. Preferably, the vertical member 23 intersects or joins the horizontal member 25 generally in the middle of the horizontal member 25, so that the ends of the horizontal member 25 are equidistant from the sides of the mount 11, the carriage 3, and the ram 5. A pair of diagonal members 27 extend from the sides of the mount 11 substantially to the ends of the horizontal member 25. The horizontal member 25 and diagonal members 27 are preferably made of sheet metal having a width generally equal to the depth (front-to-back) of the vertical member 23.

A vertical plate 29 is mounted at each end of the horizontal member 25, and a second vertical plate 31 is mounted to the vertical plate 29. A generally vertical tube 33 is mounted to each plate 31, and a leg 35 is journaled in each tube 33 to be movable vertically relative to the tube. The tube 33 and leg 35 are preferably made from square tube stock and the leg is sized to have a width and length slightly less then the width and length of the tube 33 such that the leg can be easily moved vertically relative to the tube 33, yet will not wobble much within the tube 33. The legs 35 each have a foot or plate 36 at the bottoms thereof. The feet 36 have a circumference greater than the circumference of the legs 35, and although shown to be circular, could be any desired shape.

The tube 33 has front, back and side walls and is provided with at least one hole 37 (three are shown) which extends horizontally through its front and back walls. That is, the holes in the front and back walls of the tube 33 are co-axial. The legs 35 similarly have front, back, and side walls, and have a plurality of vertically spaced apart holes 39 which are alignable with the holes 37 of the tubes 33. A pin 41 is passed through the holes 37 and 39 of the tube 33 and leg 35, respectively, to secure the leg 35 in a desired position relative to the tube 33. As can be seen best in FIG. 1, the pins 41 each have a first portion 43 which extends through the holes and a second portion 45, formed generally at a right angle to the first portion 43, and which forms a handle for the pin 41.

In use, once the post driver 1 is mounted on the three-point hitch of a tractor, the legs are positioned such that the bottoms of the legs are above the ground a sufficient distance so as to not interfere with the operation of the tractor, i.e. so that the legs will not hit the ground as the tractor is moved. During movement or travel of the post driver ram, the legs 35 will serve as "outriggers" to stabilize the post driver and to prevent it from wobbling as much on the hitch.

When the post driver is not in use, the ram 5 is positioned such that the bottom of the ram 5 is co-planar with the feet 36 of the legs 35. The three-point hitch can then be operated to lower the post driver 1, and the post driver 1 will stand upright. The tractor can then be operated, as known, to dismount the post driver 1 from the hitch. Then, all that need be done to re-mount the post driver 1 on the hitch is to position the hitch below the mount 11 of the post driver 1 and operate the hitch, as is known, to mount the post driver 1 to the hitch. As can be appreciated, this eliminates the need to hang the post driver from a wall, tree, or beam, and vastly increases the areas where the post driver can conveniently be stored when not in use.

In view of the above, it will be seen that the several objects and advantages of the present invention have been achieved and other advantageous results have been obtained. As various changes could be made in the above constructions without departing from the scope of the invention, it is intended that all matter contained in the above description or shown in the accompanying drawings shall be interpreted as illustrative and not in a limiting sense. For example, although the legs 35 are described and shown to be manually adjustable, a crank system could be used to adjust the position of legs 35. Alternatively, the legs could be hydraulically or pneumatically adjusted. Further, although the support structure 21 is generally triangular in shape, it could be square or rectangular in shape as well. These examples are merely illustrative.

We claim:

1. A post driver having a carriage and a ram movable vertically relative to said carriage, a base to which said carriage is mounted, said base extending rearwardly from said carriage and including a mount provided for connection of a post driver to a hitch of a vehicle, a support frame mounted to said base rearwardly of said carriage, said support frame having a vertical member extending downwardly from said mount and a horizontal member extending generally horizontally from a bottom of said vertical member, said horizontal member having a first end and second end, and a vertically extending leg mounted at said first end and at said second end of said horizontal member, each leg being movable vertically relative to said horizontal member, said support frame vertical member is generally centered with respect to said support frame horizontal member, said vertical member extending between said horizontal member and said mount, said support frame including a pair of diagonal side members which extend from said mount substantially to said first and second ends of said horizontal member, said mount including an adjusting assembly, said adjusting assembly including means for adjusting the lateral and forward positioning of said carriage and post driver approximately generally parallel to the ground to properly position the post driver during its usage.

2. The post driver of claim 1 wherein the support frame includes a tube at each end of said horizontal member, said vertically extending legs being journaled respectively in said tubes for vertical movement.

3. The post driver of claim 2 wherein said tubes each have at least one hole extending generally horizontally therethrough, said legs each having a plurality of vertically spaced apart holes; said post driver including a pin which extends through said tube holes and a selected one of said leg holes to fix said legs in a desired position with respect to said tube.

4. The post driver of claim 3 wherein said vertically extending legs are spaced horizontally equidistantly from said carriage.

5. A post driver having a carriage and a ram movable vertically relative to said carriage; a base to which said carriage is mounted, said base extending rearwardly from said carriage and including a mount provided for connecting to the post driver to a hitch of a vehicle; a support frame mounted to said base rearwardly of said carriage, said support frame having a vertical member depending from said mount, a generally horizontal member at the bottom of said vertical member, said horizontal member having a first end and a second end, said first and second ends of said horizontal member being generally equidistant from said carriage, a pair of diagonal members extending between said mount and said ends of said horizontal member; and a vertically extending leg mounted at said first end and at said second end of said horizontal member, said legs being movable vertically relative to said horizontal member, and said mount including an adjusting assembly, said adjusting assembly including means for adjusting the lateral and forward positioning of said carriage and post driver approximately generally parallel to the ground to properly position the post driver during its usage.

6. The post driver of claim 5 wherein the support frame includes a tube at each end of said horizontal member, said vertically extending legs being journaled respectively in said tubes for vertical movement; said tubes each having at least one hole extending generally horizontally therethrough, said vertically extending legs each having a plurality of vertically spaced apart holes; said post driver including a pin which extends through said tube holes and said leg holes to fix said legs in a selected position with respect to said tube.

7. The post driver of claim 6 including a generally vertical plate at the ends of the horizontal member, said tubes being mounted to said plate.

8. A post driver having a carriage and a ram movable vertically relative to said carriage, a base to which said carriage is mounted, said base extending rearwardly from said carriage and including a mount provided for connecting the post driver to a hitch of a tractor, a support frame mounted to said base rearwardly of said carriage, said support frame having structural members extending downwardly from said mount and generally arranged in various angular configurations to provide structural support, said support frame at its bottom, and at each side thereof, including a tube, and a vertically extending leg being journaled in each said tube for vertical movement, said vertically extending legs being adjustable heightwise to provide for leveling of said post driver when used upon uneven ground upon driving of a post therein, and said mount including adjusting assembly means that provides for the lateral and forward adjustment of the post driver and its carriage and to move the same generally parallel to the ground to properly position the post driver during usage.

* * * * *